United States Patent [19]

Eberline et al.

[11] Patent Number: 4,509,471

[45] Date of Patent: Apr. 9, 1985

[54] START SYSTEM FOR INTERNAL COMBUSTION ENGINES

[75] Inventors: William C. Eberline, Cass City, Mich.; Norman H. Radtke, Fond du Lac, Wis.; Robert L. Van Camp, Cass City, Mich.

[73] Assignee: Walbro Corporation, Cass City, Mich.

[21] Appl. No.: 456,422

[22] Filed: Jan. 7, 1983

[51] Int. Cl.[3] ..... F02N 17/00

[52] U.S. Cl. ..... 123/179 G; 123/180 R; 261/34 A

[58] Field of Search ..... 123/179 G, 180 R, 187.5 R; 261/34 A, 39 D, 51, 121 B

[56] References Cited

U.S. PATENT DOCUMENTS

| | | | |
|---|---|---|---|
| 1,974,585 | 9/1934 | Prentiss | 123/180 R |
| 2,977,948 | 4/1961 | Kittler | 123/180 R |
| 3,957,929 | 5/1976 | Gural et al. | 261/34 A |
| 4,216,175 | 8/1980 | Schauer | 123/179 G |
| 4,285,887 | 8/1981 | Akiya | 261/34 A |
| 4,390,480 | 6/1983 | Noisier | 261/34 A |

FOREIGN PATENT DOCUMENTS

| | | | |
|---|---|---|---|
| 0619007 | 3/1949 | United Kingdom | 261/34 A |

*Primary Examiner*—Parshotam S. Lall

*Attorney, Agent, or Firm*—Barnes, Kisselle, Raisch, Choate, Whittemore & Hulbert

[57] ABSTRACT

A carburetor for an internal combustion engine which includes a supplemental fuel chamber and fuel injector valve, manually or remotely actuated, to inject a charge of fuel into the fuel induction chamber of an associated engine and provide a continuing fuel supply to the engine, over and above, the normal carburetor system, to allow the engine to reach a warm-up stage and prevent stalling out until such stage is reached where normal carburetion can take over. Automatic refill and vent valves permit fuel recharge of the supplemental fuel chamber to insure readiness of the chamber for starting at all times.

1 Claim, 11 Drawing Figures

START SYSTEM FOR INTERNAL COMBUSTION ENGINES

FIELD OF INVENTION

Primary apparatus for internal combustion engines to assist in cold starts and continuing fuel supply until the engine is warmed up.

BACKGROUND OF INVENTION

Most internal combustion engines need extra fuel in the fuel system for what is generally termed "cold-starting". Automatic, heat-controlled chokes are used on many vehicle engines. This "choking" consists of blocking the air intake passage to the extent that the vacuum created by the movement of the engine pistons will be higher than normal in the fuel and air mixing passage and thus pull an extra quantity of fuel from the carburetor supply ports into the engine cylinders. After the engine has started and heat is developed in the area of the automatic choke, there will be an automatic release of the choke to allow normal air flow into the mixing passage.

With some small engines such as used on snowmobiles and outboard motors, an extra quantity of fuel is forced into the engine by a manual priming apparatus. This may facilitate the unitial starting but may not provide sufficient fuel to keep the engine running until it warms to the point that it can proceed to operate under normal carburetor conditions. Examples of priming systems operated manually are found in the Turner U.S. Pat. No. 3,371,658 (Mar. 5, 1968), O'Connor U.S. Pat. No. 3,983,857 (Oct. 5, 1976) and DuBois U.S. Pat. No. 4,309,968 (Jan. 12, 1982).

The present invention has the object of providing a manual, or remote controlled, priming system which can provide adequate supplemental fuel for initial starting but will also provide a prolonged or secondary supply of fuel to enable the engine to be fully warmed up before the secondary supply is discontinued and the normal carburetor functions begin. With outboard motors in particular, an operator may wish to get his craft underway as soon as the engine is started but it may stall shortly after starting unless a means is provided to supplement the fuel supply for a period after starting.

It is, therefore, an object to provide a carburetor with an integral body portion which houses a fuel supply to be injected into the engine for initial starting and which can receive replenishment fuel from the basic carburetor. It is a further object to provide a fuel supply system which utilizes the basic carburetor both for the initial injected starting charge but also for the supplemental secondary warm-up period. It is a further object to provide a starting system which is self-filling and which reduces itself after a start so that strenuous and repeated starting pulls are avoided. Another object and feature lies in the starting system which closes automatically after initiation to prevent fuel from being pulled from it into the enginne under normal operating conditions.

Another object lies in the adoptability of the system either to manual, at the carburetor position, or to remote power control from a cowl separated from the engine and carburetor.

Other objects of the invention will be apparent in the following description and claims in which the invention is described together with the manner and process of using it as directed to persons skilled in the art to enable use and practice of the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
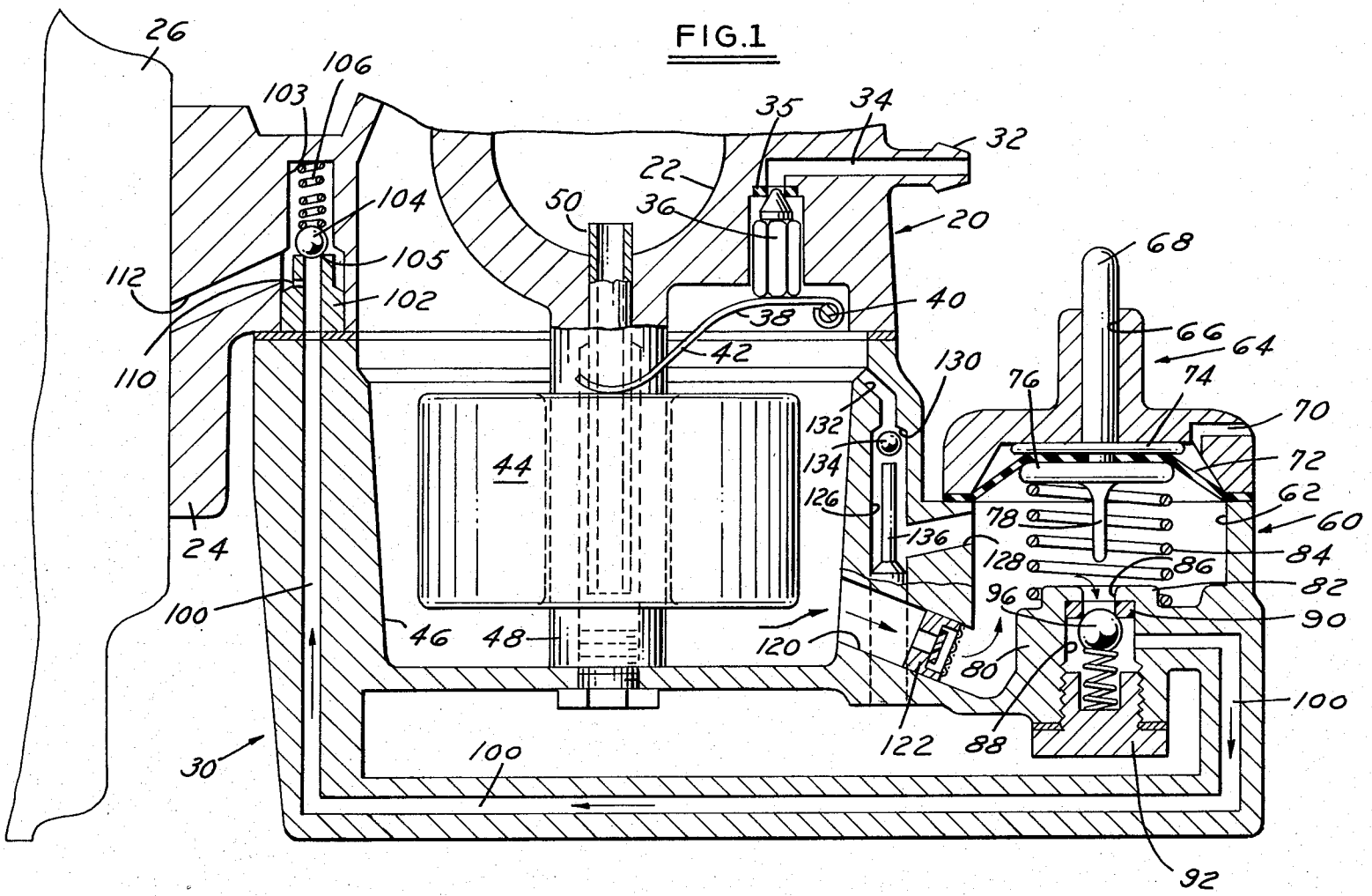
FIG. 1, a diagrammatic view of the system in connection with a float carburetor.

With reference to the drawing, in FIG. 1, a carburetor body 20 has a mixing passage 22 and a mounting flange 24 secured to an engine housing 26 at the fuel induction chamber. The presentation in FIG. 1 is partially diagrammatic to enable the concept to be presented in a single plane. The remaining FIGS. 2 to 10 show how the concept can be adapted to a commercial carburetor.

Below the carburetor body 20 is a float chamber housing 30 which would be secured and sealed to the body 20 in a suitable manner. Body 20 has a fuel inlet nipple 32 connected to a passage 34 terminating at a valve seat 35. This nipple 32 will be connected to a suitable fuel supply reservoir. An inlet valve 36 rides on a lever 38 pivoted at 40. The curved distal end 42 of lever 38 rides on the top of a fuel float 44 which is suitably mounted in the fuel chamber 46 of the housing 30. The float 44 is guided on a central column 48 which carries a main nozzle tube 50 in communication with the fuel chamber and open to the venturi portion of the mixing passage 22. The required throttle valve of standard construction is not shown in this FIG. 1.

Integral with body 30 is a body 60 having a fuel injection chamber 62. A plunger cap 64 is suitably secured to the body 60. The cap has a central bore 66 to receive a plunger shaft 68. The interior of the cap is vented to atmosphere by a port 70. An expulsion diaphragm 72 is secured at its periphery between registering flanges of the body 60 and the cap 64.

The central area of the diaphragm 72 is clamped between a disc 74 and a disc 76 secured to the bottom end of plunger 68, which has an actuator pin 78 depending therefrom. The disc 76 has an interference fit with the base of pin 78 and is sonic welded to the pin. These parts can be made from a suitable plastic having good resistance to hydrocarbons.

In the base of the body 60 is a central riser 80 having an ensmalled portion 82 to serve as a seat for a coil compression spring 84 which seats at the other end on disc 76 to urge the plunger 68 and diaphragm 72 to an "up" position. An opening 86 and a bore 88 provide a seat location for a valve seat 90. A threaded screw plug provide a spring closure 92 serving as a seat for the lower end of a coil spring 94 which bears at the other end against a valve check ball 96 serving as a main injector valve. The projection of the shaft 68 out of the cap 64 must be dimensioned such that when the plunger is depressed, the pin 68 will move the ball 96 off the seat 90.

The bore 88 has a port between the ball 96 and the threaded closure plug 92 which leads to a passage 100 in housings 30 and 60 terminating at plug 102 in the lower end of a stepped bore 103 in housing 20. The plug 102 has a central bore connected to passage 100 at the top of which is a discharge valve seat 105 against which a ball valve 104 is pressed by a coil spring 106 seated at the top of the bore 103.

The plug 102, which has the valve seat 105 at the end thereof, also has a calibrated side passage 110. A fuel port 112 in body 20 and flange 24, leading to the engine fuel supply manifold (induction chamber), connects to the bore 103 and, through passage 110, is also in communication with the passage 100.

Returning for the moment to the injection chamber 62, a fuel passage 120 leads from the bottom of the float chamber 46 to the bottom of the injection chamber through a one-way valve insert 122 which admits fuel into chamber 62. A second vertical passage 126 has a side branch 128 open to chamber 62 and a top valve seat 130 open to a passage 132 communicating with the to of the float chamber 46. A check valve ball vent valve 134, which is preferably formed of a material such as nylon, is held in a valve relationship adjacent to seat 130 by a pin 136 pressed into the bottom of bore 126. OPERATION OF THE FIGURE DISCLOSURE Assuming that the float chamber is charged with fuel, the check valve 122 will allow fuel to flow into the fuel injection chamber 62. The vent valve 134, will provide air release as the chamber 62 fills.

When the assembly is being used in the starting of a cold engine, the plunger 68 is depressed to actuate the expulsion diaphragm and increase pressure in chamber 62. Initially, this pressure, exerted through the movement of the diaphragm, will close the inlet valve 122 and the vent valve 134. As the plunger is further depressed against the body of fuel in chamber 62 and against the resilience of the spring 84, the actuator pin 78 will contact the resiliently biased main injector valve 96 and dislodge it from the seat 90. Fuel will then be forced through the piston action of the expulsion diaphragm to the passage 100 and the ball valve 104 will move off from its seat against the spring 106 to allow a reasonably large charge of fuel to reach the passage 112 leading to the fuel manifold of an engine.

A starting movement of the engine, whether by a manual pull or an electric starter, will draw this charge of fuel into the engine and, assuming normal spark action, will cause the engine to start. Once the fuel is expelled from the chamber 62 by the depression of the plunger assembly 68, and the passage of the fuel charge through valve 104, the pressure in passage 100 will diminish and valve 104 will close. However, a continued depression of the plunger 68 will keep the main injector valve 96 open and fuel can continue to flow to the engine from chamber 62 and passage 100 through the calibrated side port 110. Thus, a continued supply of extra fuel, over and above that for which the engine and the carburetor are calibrated, will flow through the carburetor and will reach the engine during a warm-up period to prevent stalling. After a warm-up period, the plunger can be released and the engine will run on the normal fuel supply for which the carburetoor is calibrated.

Upon release of the plunger 68, the spring 84 will move the diaphragm 72 up and the chamber 62 will refill through the valve 122. At the same time the main injector valve 96 will close to prevent fuel from being sucked out of the fuel injectionn chamber 62 during the normal engine operation.

With the described system, the chamber will always have fuel when the float chamber is full and there is no need to prime this chamber in the starting operation. Thus, "one-pull" starting can usually be achieved.

THE EMBODIMENT OF FIGS. 2 TO 8

Figure 2:
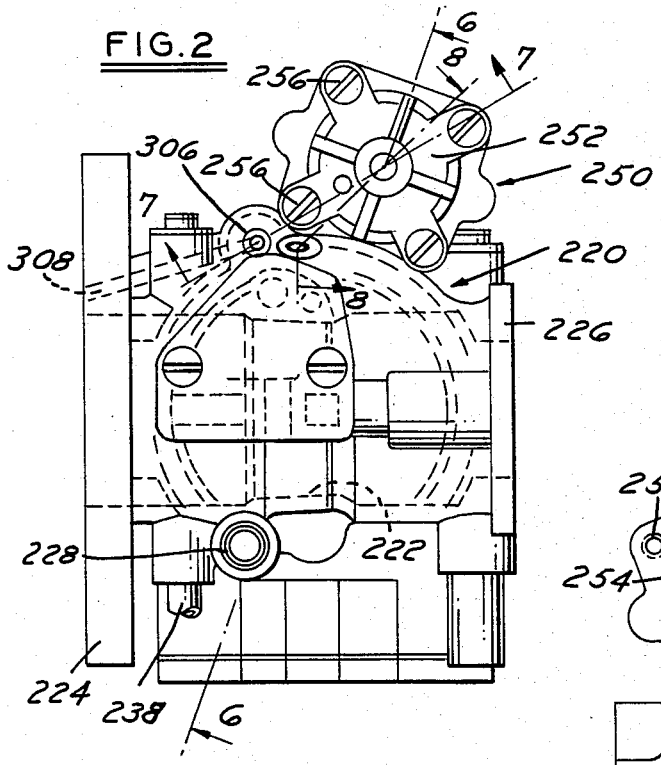
FIG. 2, a top view of a carburetor incororating the starting system.

In FIGS. 2 to 8, a float carburetor is illustrated incorporating the invention. A top view of the assembly in FIG. 2 shows a body 220 having a venturi passage 222 (dotted lines) and an engine mounting flange 224. An air inlet mounting flange 226 is provided at the other end of the carburetor. A fuel inlet connection 228 leads to an inlet valve as shown in FIG. 1 controlled by the position of the float 230 in a float chamber 232. A throttle shaft control 238 operates a throttle valve 240. Generally speaking, no choke valve is needed with the fuel injection system described herein.

Integral with the float bowl housing, which is secured by a nut 242, is a fuel injector assembly 250 having a top housing 252 and a bottom housing 254 secured by screws 256 (FIGS. 2, 3, 4 and 8). A fuel pump 258 of standard construction, actuated by engine pulses, is appended to the housing 220 to provide fuel to the float chamber.

Figure 5:
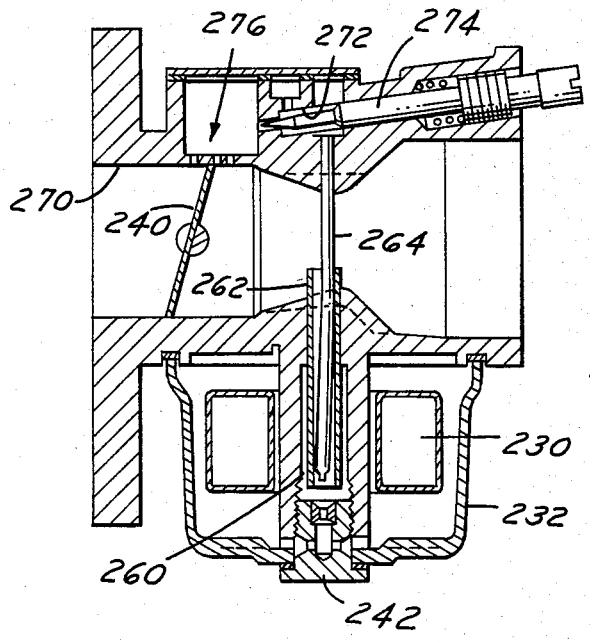
FIG. 5, a central sectional view of a carburetor showing the float and idle control.

In FIG. 5, fuel from the float chamber enters a center well 260 through side and center passages in the screw 242 and becomes available to the lower end of concentric tubes, namely, an outer main fuel nozzle tube 262 and an inner idle tube 264. The outer nozzle tube opens to the venturi of an air mixing passage 270. The inner tube opens to a chamber 272, the outlet of which is controlled by an adjustable idle needle valve 274 which admits the idle fuel supply to idle ports 276 opening to the mixing passage 270.

Figure 6:
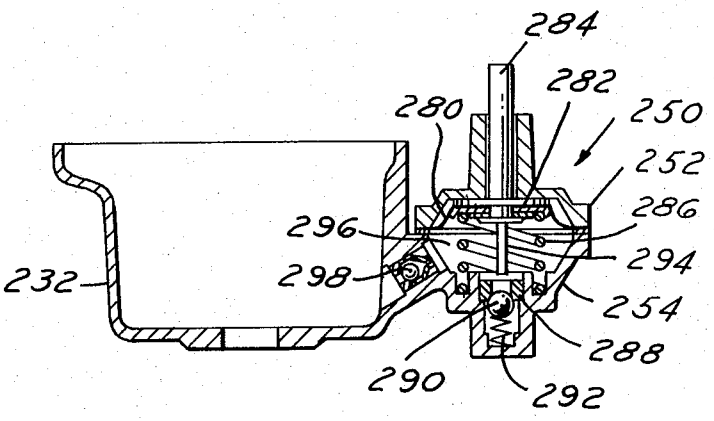
FIG. 6, a sectional view of the injection system and float chamber taken on line 6—6 of FIG. 2.
Figure 7:
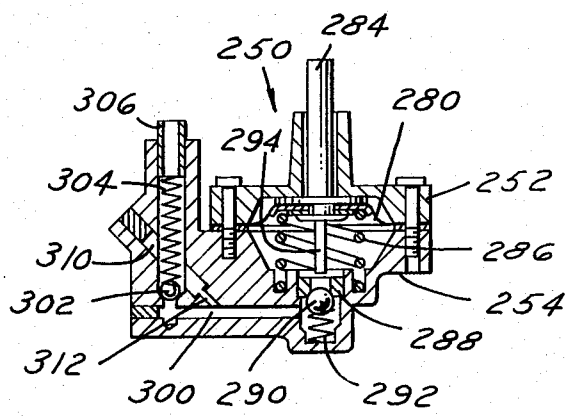
FIG. 7, a sectional view of the injection system taken on line 7—7 of FIG. 2.

In FIGS. 6 and 7, two sectional view of the fuel injector assembly are shown. In FIG. 6, a section on line 6—6 of FIG. 2, it will be seen that the housings 252 and 254 clamp the periphery of a diaphragm 280 in a sealing arrangement. The center of the diaphragm is clamped between a disc enlargement on the bottom of a plunger shaft 284 and a disc 282, and a spring 286 urges the plunger to an up position. In the base of the housing 254 is a valve seat 288, closed normally by a main injector valve 290 biased to a closed position by a spring 292. A downwardly projecting stem 294 on plunger shaft 284 is provided to move valve 290 away from seat 288. A chamber 296 below the diaphragm is open to the float bowl chamber 232 through an unbiased check valve 298 which allows fuel to flow from the float chamber to chamber 296.

In FIG. 7, it will be seen that the small chamber below valve 290 is open through a passage 300 to a spring biased check valve 302 leading to a bore 304 which opens to a passage 306 connected to a cross passage 308 (FIG. 2, dotted lines) leading to the engine flange 224 and the fuel induction passage of the engine on which the carburetor is mounted. Referring back to FIG. 7, an angled passage 310 has a calibrated portion 312 which by-passes the check valve 302.

Figure 11:
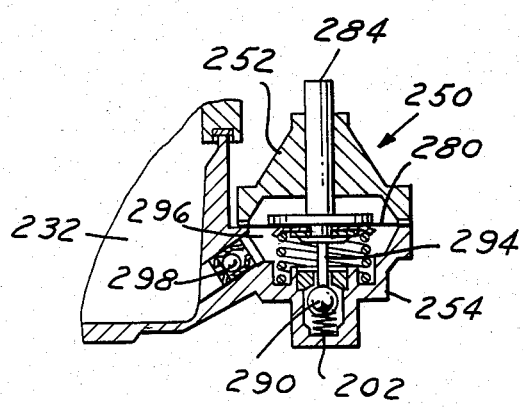
FIG. 11, a sectional view similar to FIG. 6 with the actuator depressed.

When the plunger 284 is depressed, the projecting end 294 of the plunger will contact and move the main injector valve 290 to open this valve 290. This will force fuel through the passage 300 and past valve 302 to the fuel induction chamber of the engine to provide a starting charge. As long as the plunger is depressed, fuel can move through the calibrated passage 312 after the valve 302 closes and additional fuel will be available to the engine during a warm-up period. In FIG. 11, the plunger 284 is shown depressed and the valve 290 open.

Figure 8:
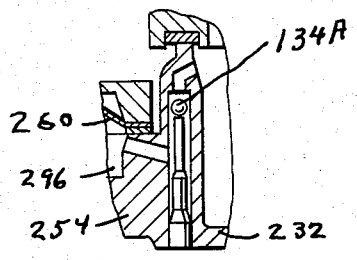
FIG. 8, a sectional view on line 8—8 of FIG. 2.
Figure 3:
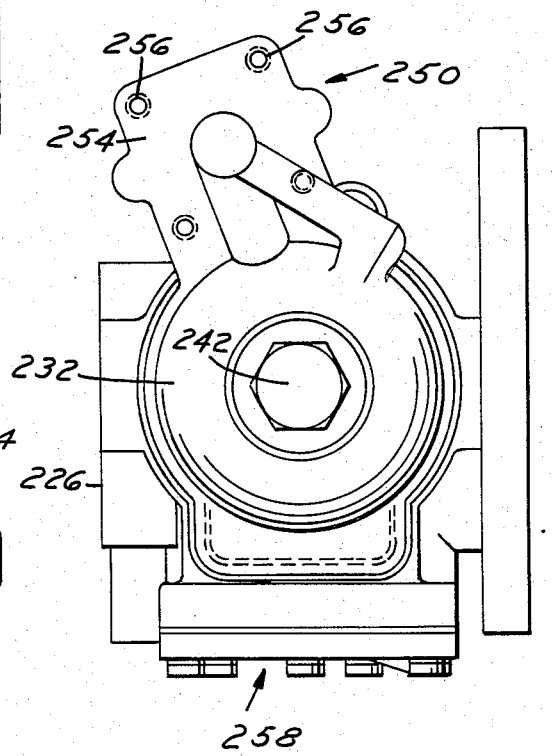
FIG. 3, a bottom view of the carburetor shown in FIG. 2.
Figure 4:
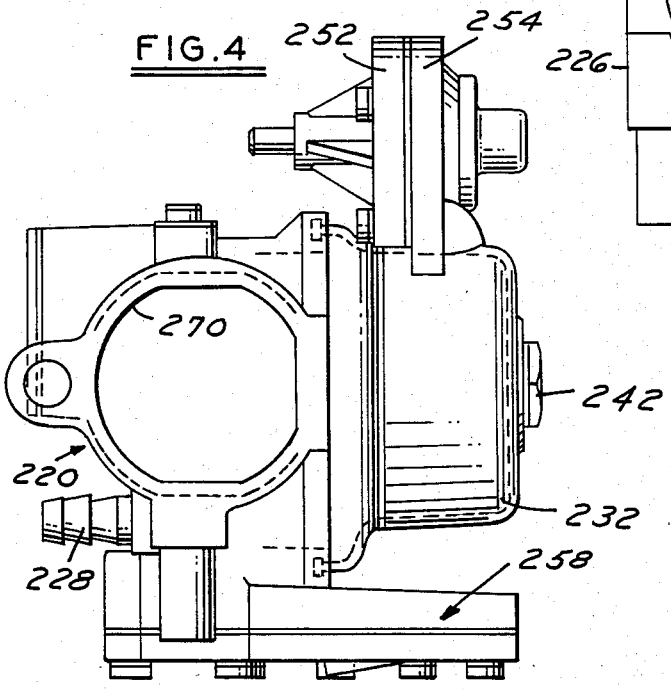
FIG. 4, an end view of the carburetor illustrated in FIGS. 2 and 3.

A vent valve 134A shown in the sectional view of FIG. 8, like valve 134 in FIG. 1, is provided to allow the diaphragm chamber 296 to fill through the check valve 298. When the diaphragm 280 is depressed, both the vent valve 134A and the inlet check valve 298 will close.

Figure 10:
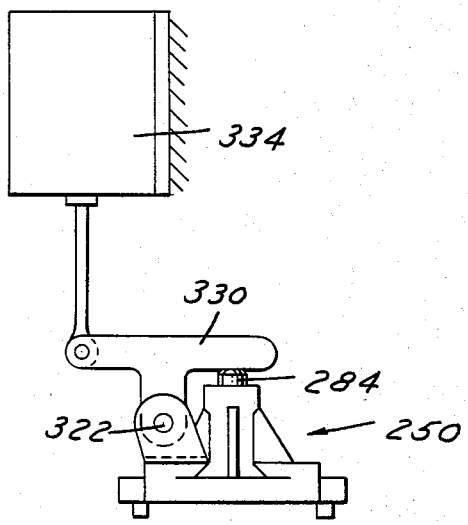
FIG. 10, a view of a solenoid operated actuator.
Figure 9:
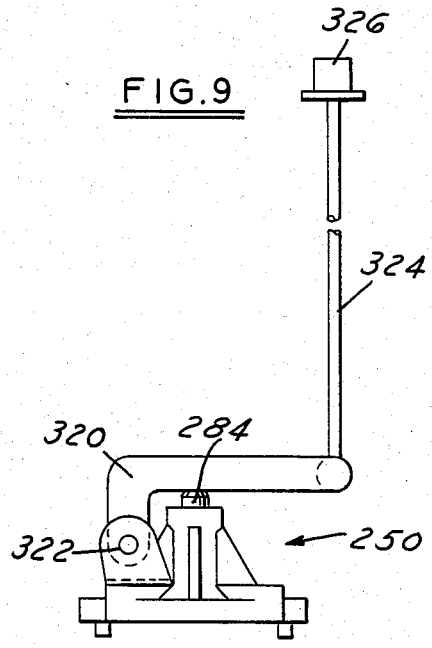
FIG. 9, a view of a remote mechanical actuator.

In FIGS. 9 and 10, alternate operating mechanisms are shown. In FIG. 9, a mechanical linkage is illustrated. An L-shaped lever 320 pivoted at 322 is actuated by a shaft 324 with a remote plunger 326. In FIG. 10, a T-lever 330 pivoted at 332 has one end overlying plunger 284. A solenoid 334 actuates the other end of lever 330 to depress the plunger on a signal from an operator.

When the plunger is depressed, it is desirable that a linking mechanism (not shown) open the throttle slightly to a calibrated position in relation to the size of the passage 312. In FIG. 11, the sectional view similar to the view in FIG. 6, illustrates the plunger 284 in the depressed position with the valve 290 open.

Thus, it will be seen that the integral fuel injection system, permits fast starts in cold engines and provides additional supplemental fuel at idle speeds to keep the engine running as it warms up to the degree that normal carburetion may be relied upon. Furthermore, the starting system is always ready for operation since the fuel in the chamber automatically replenishes and cannot be purged from the injection chamber by the high vacuum in the mixing passage of the carburetor during normal operation.

What is claimed is:

1. In a float carburetor for providing fuel to engines, such as outboard motors, of the type having a body forming a float chamber, a fuel and air mixing passage connected to the fuel induction chamber of an engine, a main fuel nozzle and idle passages connected to said mixing passage, a supplemental fuel chamber laterally adjacent said float chamber in the carburetor body with expulsion means which, upon actuation, will expel fuel from the fuel chamber, that improvement which comprises means forming an inlet passage to the base of said chamber connected to the base of said float chamber and an outlet air vent passage at the top of said chamber connected to the top of said float chamber, normally open, one-way valves in said passages to allow fuel to flow freely into said chamber from said float chamber and closed upon actuation of said expulsion means, means forming an auxiliary fuel passage connecting said supplemental fuel chamber to a fuel receiving portion of an internal combustion engine, a first one-way valve at the chamber end of said auxiliary passage mechanically opened by actuation of said explusion means to allow flow from said chamber to said auxiliary passage, a second normally closed, spring-biased one-way valve at the engine end of said auxiliary passage opened by pressure in said chamber and said auxiliary passage created by actuation of said expulsion means, and a third calibrated passage opening from said auxiliary passage to said engine to admit fuel to said engine when said first one-way valve is open by said expulsion means and said second one-way valve is open by said explusion means and said second one-way valve is closed.

* * * * *